US009463394B2

(12) United States Patent
Striggow

(10) Patent No.: US 9,463,394 B2
(45) Date of Patent: Oct. 11, 2016

(54) VISUAL MOVEMENT DISPLAY SYSTEM

(71) Applicant: Lewis James Striggow, Fort Collins, CO (US)

(72) Inventor: Lewis James Striggow, Fort Collins, CO (US)

( * ) Notice: Subject to any disclaimer, the term of this patent is extended or adjusted under 35 U.S.C. 154(b) by 0 days.

(21) Appl. No.: 14/621,058

(22) Filed: Feb. 12, 2015

(65) Prior Publication Data

US 2015/0231520 A1 Aug. 20, 2015

Related U.S. Application Data

(60) Provisional application No. 61/940,039, filed on Feb. 14, 2014.

(51) Int. Cl.

| | |
|---|---|
| ***A63H 3/06*** | (2006.01) |
| ***A63H 33/00*** | (2006.01) |
| ***G09F 19/02*** | (2006.01) |

(52) U.S. Cl.

CPC ..... *A63H 33/00* (2013.01); *G09F 19/02* (2013.01)

(58) Field of Classification Search

CPC ..... G09B 27/02; G09B 23/06; G09B 23/24
USPC ..... 446/233, 236; 434/284, 285, 287, 288, 434/290–293, 300, 302
See application file for complete search history.

(56) References Cited

U.S. PATENT DOCUMENTS

| | | | | |
|---|---|---|---|---|
| 25,476 | A * | 9/1859 | McKendree | G09B 27/02 434/291 |
| 532,370 | A | 1/1895 | Gibbs | |
| 846,925 | A | 3/1907 | Kramer | |
| 1,148,891 | A * | 8/1915 | Allen | G09B 27/02 434/284 |
| 1,189,141 | A | 6/1917 | Lanneau | |
| 1,342,871 | A | 6/1920 | Ruggles | |
| 2,418,718 | A * | 4/1947 | Maginley | G09B 27/02 434/291 |
| 2,878,591 | A | 3/1959 | Harris | |
| 2,903,820 | A | 9/1959 | Bodell | |
| 3,107,439 | A | 10/1963 | Parr et al. | |
| 3,107,441 | A | 10/1963 | Scott | |
| 3,141,669 | A | 7/1964 | Chul | |
| 3,164,382 | A | 1/1965 | Johnson | |
| 3,276,777 | A | 10/1966 | Pruitt | |
| 3,683,526 | A | 8/1972 | Horvath | |

(Continued)

FOREIGN PATENT DOCUMENTS

| | | |
|---|---|---|
| DE | 10013829 | 10/2001 |
| DE | 102005031020 | 1/2007 |

*Primary Examiner* — Melba Bumgarner
*Assistant Examiner* — Joseph B Baldori
(74) *Attorney, Agent, or Firm* — Craig R. Miles; CR Miles P.C.

(57) ABSTRACT

A visual movement display system including a first annular member; a first coupling element coupled to the first annular member, the first coupling element rotatably coupling the first annular member to a support element, the first coupling element defining a first rotation axis about which the first annular member rotates; a second annular member disposed within the first annular member; a second coupling element coupled to the second annular member, the second coupling element rotatably coupling the second annular member to the first annular member, the second coupling element defining a second rotation axis about which the second annular member rotates; whereby the second rotation axis can be offset in relation to the first rotation axis by a first angle; and a first weight element coupled to the second annular member, whereby the first weight element can be offset in relation to the second rotation axis by a second angle.

20 Claims, 8 Drawing Sheets

(56) References Cited

U.S. PATENT DOCUMENTS

| | | | | |
|---|---|---|---|---|
| 4,008,534 | A | 2/1977 | Swartz | |
| 4,156,975 | A | 6/1979 | Harding | |
| 4,402,500 | A | 9/1983 | Coles | |
| 4,799,667 | A | 1/1989 | Suchy | |
| 4,824,099 | A | 4/1989 | Rusu et al. | |
| 4,916,752 | A | 4/1990 | Thompson | |
| 5,046,721 | A | 9/1991 | Altare | |
| 5,342,244 | A | 8/1994 | Nelson | |
| 5,759,107 | A | 6/1998 | Nagel | |
| 6,113,456 | A * | 9/2000 | Hadzicki | A63H 1/30 446/250 |
| 6,565,360 | B1 | 5/2003 | Kavvouras | |
| 6,722,890 | B2 | 4/2004 | Kiel | |
| 6,832,944 | B2 * | 12/2004 | Ostrow | A63H 33/40 40/430 |
| 6,962,015 | B2 | 11/2005 | Tyler et al. | |
| 6,994,605 | B2 | 2/2006 | Baxter et al. | |
| 7,056,183 | B2 | 6/2006 | Pedoto | |
| 7,172,511 | B2 | 2/2007 | Casey | |
| 7,402,110 | B2 | 7/2008 | Casey | |
| 7,451,667 | B2 | 11/2008 | Hamady | |
| 7,559,766 | B2 | 7/2009 | Epley et al. | |
| 8,062,036 | B2 | 11/2011 | Cantor | |
| 8,066,576 | B2 | 11/2011 | Threlkel | |
| 2004/0005841 | A1 | 1/2004 | Chernick et al. | |
| 2008/0090488 | A1 | 4/2008 | Lightner | |

* cited by examiner

VISUAL MOVEMENT DISPLAY SYSTEM

This United States Non-Provisional patent application claims the benefit of U.S. Provisional Patent Application No. 61/940,039, filed Feb. 14, 2014, hereby incorporated by reference herein.

I. SUMMARY OF THE INVENTION

A broad object of a particular embodiment of the invention can be to provide a visual movement display system including a first annular member; a first coupling element coupled to the first annular member, the first coupling element rotatably coupling the first annular member to a support element, the first coupling element defining a first rotation axis about which the first annular member rotates; a second annular member disposed within the first annular member; a second coupling element coupled to the second annular member, the second coupling element rotatably coupling the second annular member to the first annular member, the second coupling element defining a second rotation axis about which the second annular member rotates; whereby the second rotation axis can be offset in relation to the first rotation axis by a first angle in a range of between about of about 1 degree to about 89 degrees; and a first weight element coupled to the second annular member, whereby the first weight element can be offset in relation to the second rotation axis by a second angle in a range of between about of about 1 degree to about 89 degrees.

Another broad object of a particular embodiment of the invention can be to provide a method of making a visual movement display system including providing a first annular member; rotatably coupling the first annular member to a support element with a first coupling element, the first coupling element defining a first rotation axis about which the first annular member rotates; disposing a second annular member within the first annular member; rotatably coupling the second annular member to the first annular member with a second coupling element, the second coupling element defining a second rotation axis about which the second annular member rotates; whereby the second rotation axis can be offset in relation to the first rotation axis by a first angle in a range of between about of about 1 degree to about 89 degrees; and coupling a first weight element to the second annular member, whereby the first weight element can be offset in relation to the second rotation axis by a second angle in a range of between about of about 1 degree to about 89 degrees.

Another broad object of a particular embodiment of the invention can be to provide a method of using a visual movement display system including providing the visual movement display system comprising a first annular member; a first coupling element coupled to the first annular member, the first coupling element rotatably coupling the first annular member to a support element, the first coupling element defining a first rotation axis about which the first annular member rotates; a second annular member disposed within the first annular member; a second coupling element coupled to the second annular member, the second coupling element rotatably coupling the second annular member to the first annular member, the second coupling element defining a second rotation axis about which the second annular member rotates; whereby the second rotation axis can be offset in relation to the first rotation axis by a first angle in a range of between about of about 1 degree to about 89 degrees; and a first weight element coupled to the second annular member, whereby the first weight element can be offset in relation to the second rotation axis by a second angle in a range of between about of about 1 degree to about 89 degrees; and rotating the first annular member about the first rotation axis.

Naturally, further objects of the invention are disclosed throughout other areas of the specification, drawings, and claims.

II. BRIEF DESCRIPTION OF THE DRAWINGS

III. DETAILED DESCRIPTION OF THE INVENTION

Figure 1A:
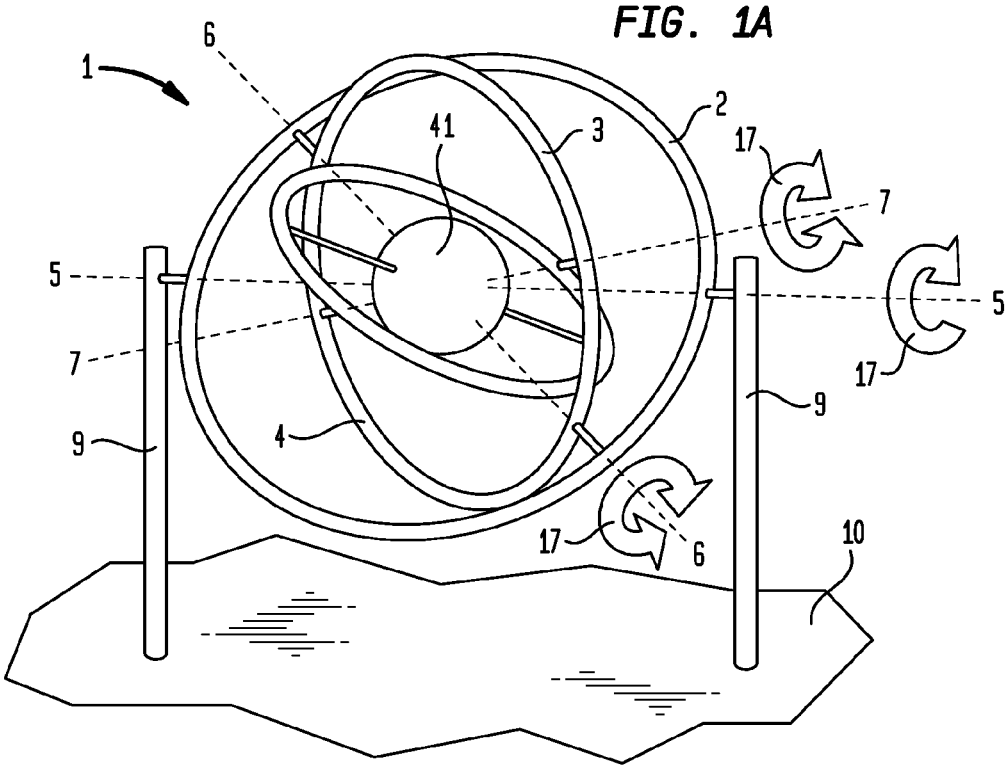
FIG. 1A is a perspective view of a first configuration of a particular embodiment of a visual movement display system.
Figure 1B:
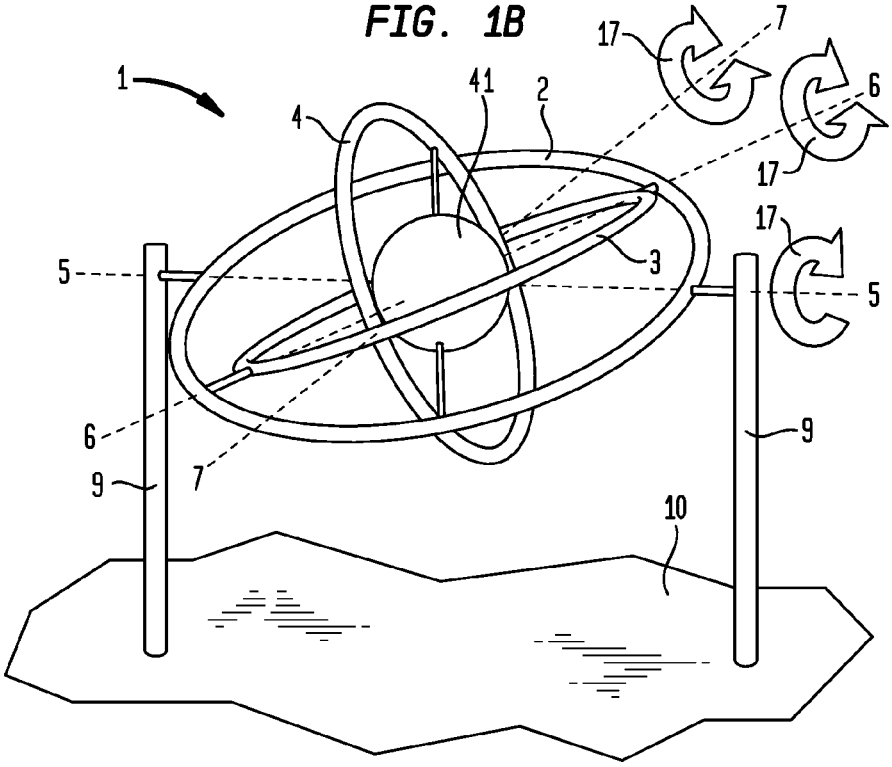
FIG. 1B is a perspective view of a second configuration of the particular embodiment of a visual movement display system shown in FIG. 1A.
Figure 1C:
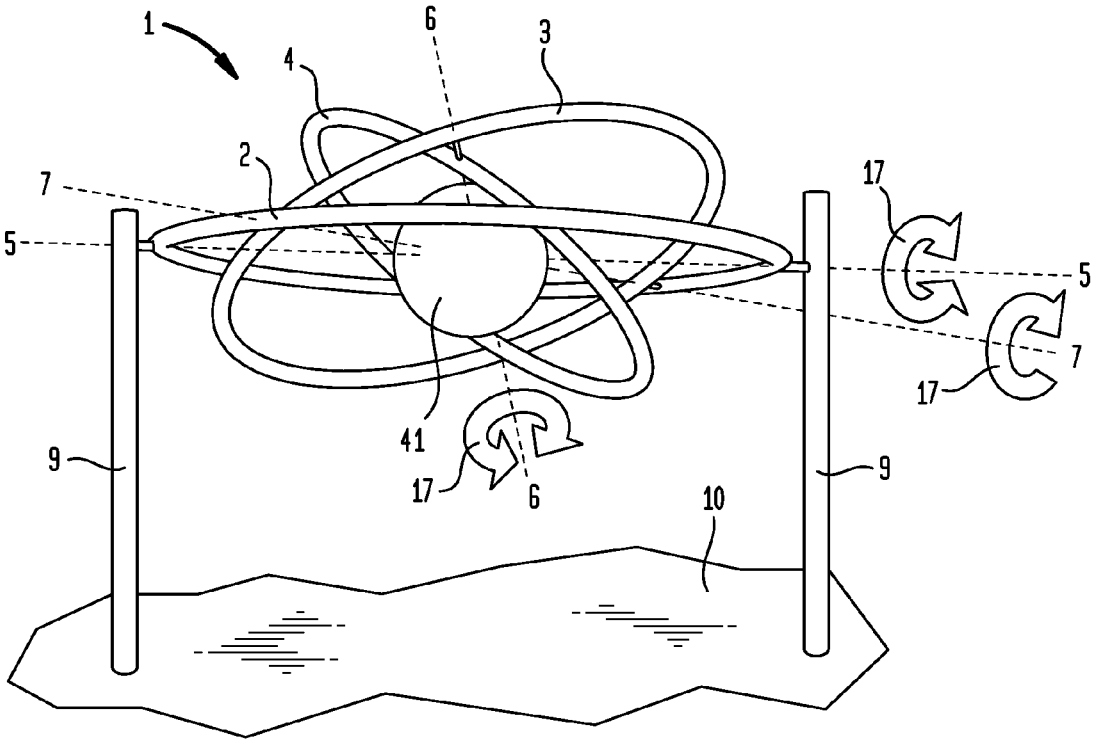
FIG. 1C is a perspective view of a third configuration of the particular embodiment of a visual movement display system shown in FIG. 1A and FIG. 1B.
Figure 2:
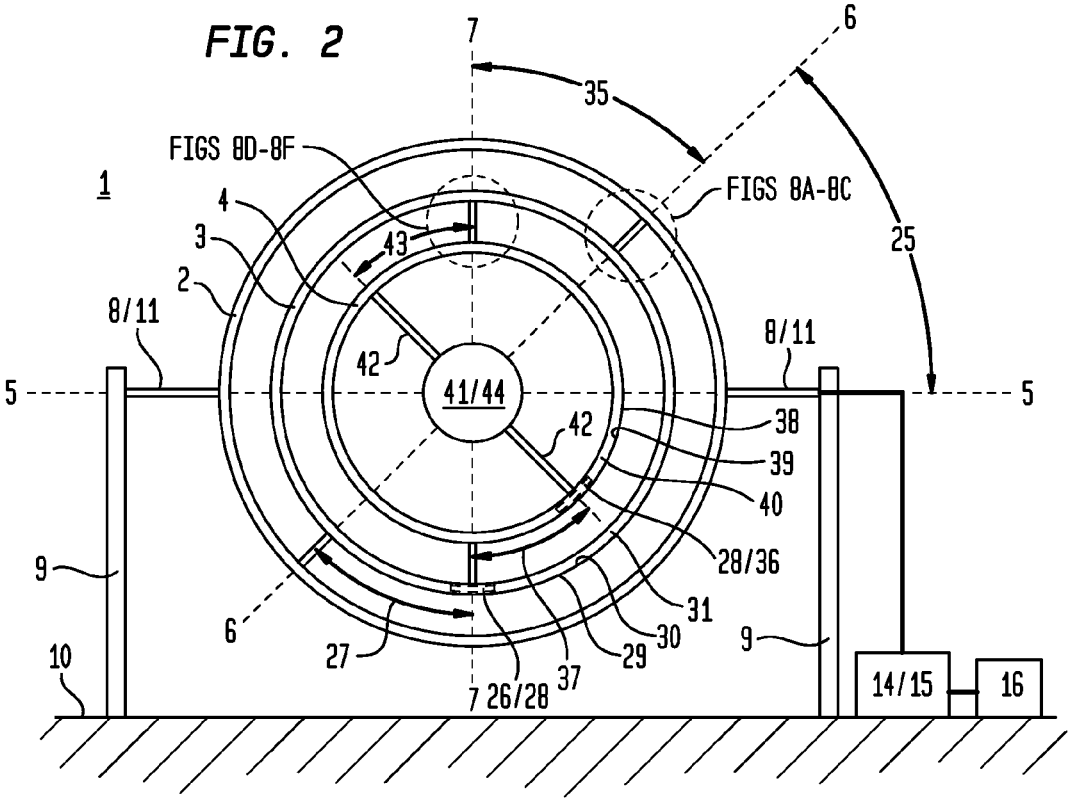
FIG. 2 is a front view of a particular embodiment of a visual movement display system.
Figure 3:
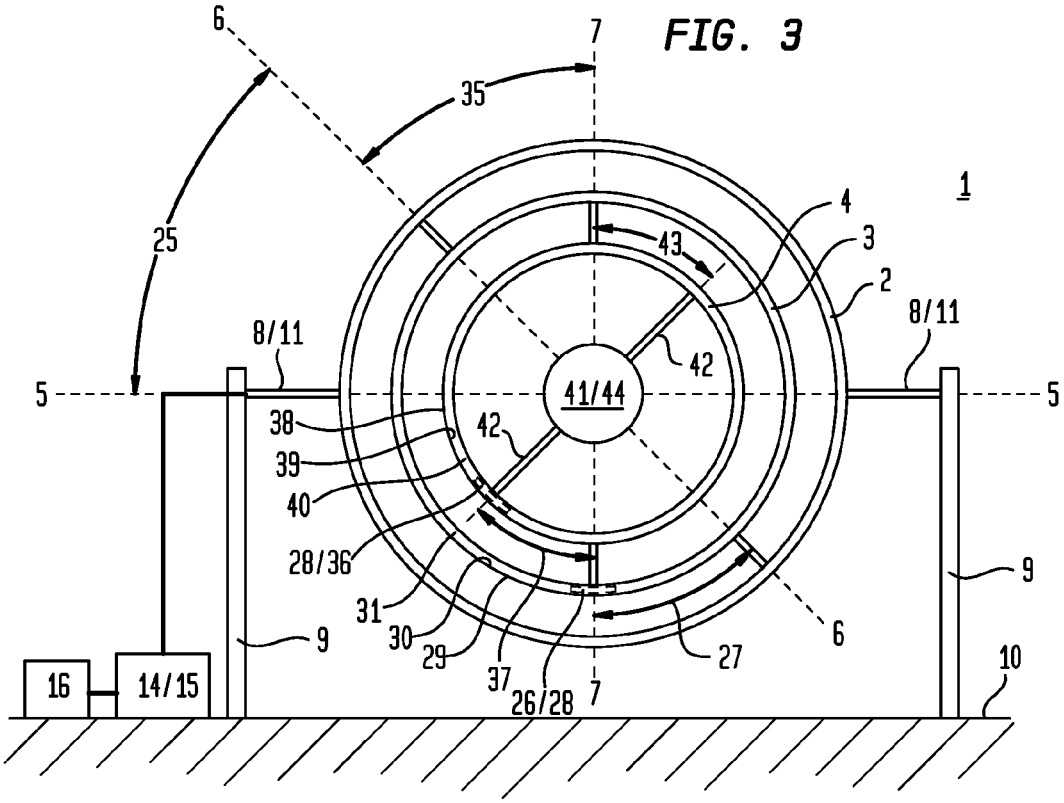
FIG. 3 is a back view of a particular embodiment of a visual movement display system.
Figure 4:
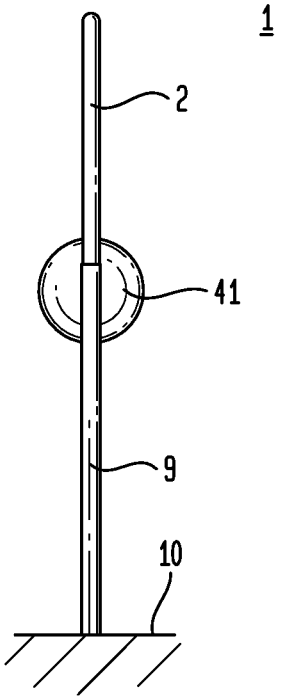
FIG. 4 is a first side view of a particular embodiment of a visual movement display system.
Figure 5:
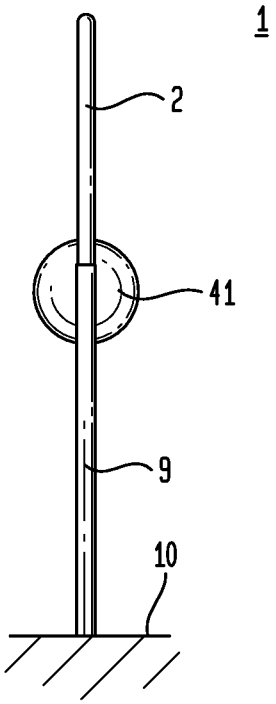
FIG. 5 is a second side view of a particular embodiment of a visual movement display system.
Figure 6:
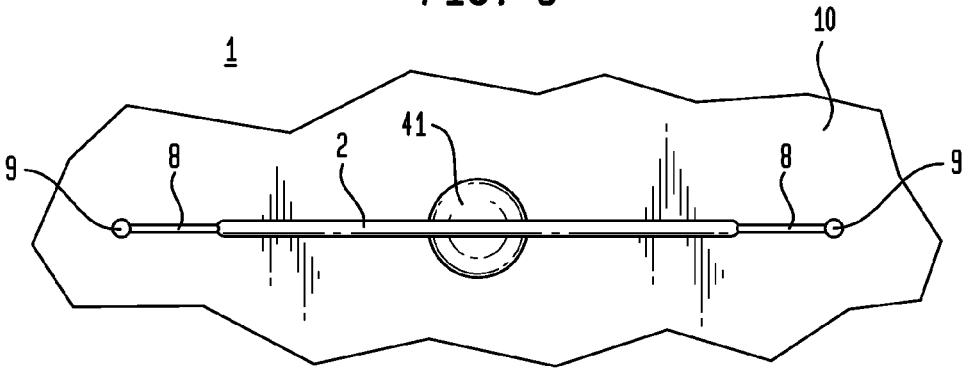
FIG. 6 is a top view of a particular embodiment of a visual movement display system.
Figure 7:
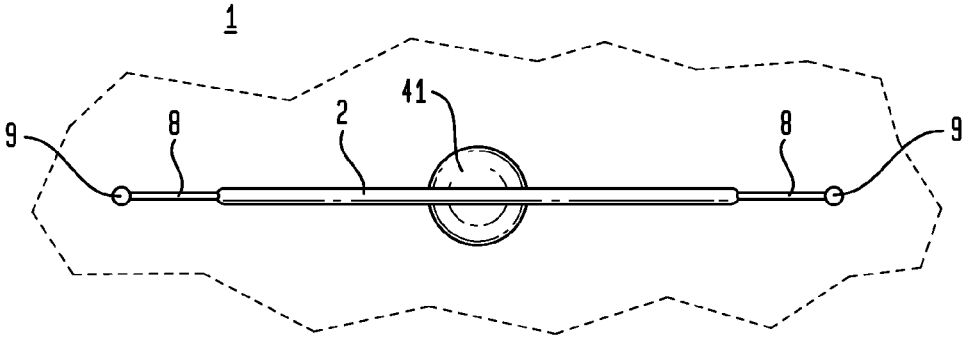
FIG. 7 is a bottom view of a particular embodiment of a visual movement display system.

Now referring primarily to FIG. 1A, FIG. 1B, and FIG. 1C, which illustrate various configurations of a particular embodiment of a visual movement display system (1) having first, second, and third annular members (2)(3)(4) which can each rotate about corresponding first, second, and third rotation axes (5)(6)(7) to generate a visual movement display. As to particular embodiments, the visual movement display can be viewed by a viewer for entertainment, amusement, enjoyment, or the like, or combinations thereof.

Now referring primarily to FIG. 2 through FIG. 7, the visual movement display system (1) can include a first annular member (2) and a first coupling element (8) coupled to the first annular member (2), the first coupling element (8) rotatably coupling the first annular member (2) to a support element (9), whereby the support element (9) can support the first annular member (2) above a support surface (10).

The support element (9) can be formed from any material and can have any configuration capable of supporting the first annular member (2) above the support surface (10), including metal, wood, stone, plastic, or the like, or combinations thereof.

The first annular member (2), as well as additional annular members, can have any of a numerous and wide variety of configurations. As non-limiting examples, an annular member can be configured to have a periphery which defines a circle, an oval, an ellipse, a triangle, a square, a rectangle, a polygon, a freeform shape, or the like, or combinations thereof.

The first annular member (2), as well as additional members, can be formed from any of a numerous and wide variety of materials, including, as non-limiting examples, metal, wood, plastic, or the like, or combinations thereof. As an illustrative example, the first annular member (2) can be formed from a steel rod or tube having a generally circular cross-section, the steel tube having a diameter of about 0.75 inches (about 19 millimeters).

Again referring primarily to FIG. 2 through FIG. 7, the first coupling element (8) can define a first rotation axis (5) about which the first annular member (2) rotates. As an illustrative example, the first coupling element (8) can be configured as an elongate member (11) (such as a rod, tube, pin, or the like) having a generally circular cross-section, the elongate member (11) outwardly extending from the first annular member (2). The elongate member (11) can be rotatably received within a support element aperture element opening bounded by a support element aperture element disposed within the support element (9), the support element aperture element opening configured to allow rotation of the elongate member (11) and correspondingly, the first annular member (2), about the first rotation axis (5) defined by the first coupling element (8) configured as the elongate member (11).

As to particular embodiments, a bearing, bushing, or the like, can be disposed within the support element aperture element opening, whereby the bearing, bushing, or the like, can rotatably receive the elongate member (11), allowing rotation of the elongate member (11) and correspondingly, the first annular member (2), about the first rotation axis (5) defined by the first coupling element (8) configured as the elongate member (11).

Again referring primarily to FIG. 2 through FIG. 7, the first coupling element (8) can rotatably couple the first annular member (2) to the support element (9) to dispose the first rotation axis (5) generally horizontally or in generally parallel relation to the support surface (10). However, the invention need not be so limited, as the first coupling element (8) can rotatably couple the first annular member (2) to the support element (9) to dispose the first rotation axis (5) in any relation, including any angled relation, to the support surface (10), depending upon the desired visual movement display.

Rotation of the first annular member (2) about the first rotation axis (5) can be generated by forcible urging upon the first annular member (2), for example by manual forcible urging (such as forcible urging which may be provided by a viewer of the visual movement display system (1)) or automated forcible urging (such as forcible urging which may be provided by a machine), depending upon the application.

Again referring primarily to FIG. 2 through FIG. 7, the visual movement display system (1) can further include a driver (14) operably coupled to the first annular member (2) to drive rotation of the first annular member (2) about the first rotation axis (5). As to particular embodiments, the driver (2) can be connected to the first coupling element (8) to drive rotation of the first annular member (2) about the first rotation axis (5).

As an illustrative example, the driver (14) can be configured as a motor (15), such as any conventional motor (15) capable of driving rotation of the first annular member (2) about the first rotation axis (5), as would be known to one of ordinary skill in the art. In addition, the driver (14) can be operably coupled to a power source (16), such as any conventional power source (16) capable of providing power to the driver (14) to drive rotation of the first annular member (2) about the first rotation axis (5), as would be known to one of ordinary skill in the art.

The driver (14) can generate a rotational speed (17) of the first annular member (2) about the first rotation axis (5), whereby the rotational speed (17) can be in a range of between about 5 revolutions per minute to about 60 revolutions per minute. However, the invention need not be so limited, as the rotational speed (17) can be lesser than 5 revolutions per minute or greater than 60 revolutions per minute, depending upon the desired visual movement display. As to particular embodiments, the rotational speed (17) can be selected from the group including or consisting of: between about 5 revolutions per minute to about 15 revolutions per minute; between about 10 revolutions per minute to about 20 revolutions per minute; between about 15 revolutions per minute to about 25 revolutions per minute; between about 20 revolutions per minute to about 30 revolutions per minute; between about 25 revolutions per minute to about 35 revolutions per minute; between about 30 revolutions per minute to about 40 revolutions per minute; between about 35 revolutions per minute to about 45 revolutions per minute; between about 40 revolutions per minute to about 50 revolutions per minute; between about 45 revolutions per minute to about 55 revolutions per minute; and between about 50 revolutions per minute to about 60 revolutions per minute. As an illustrative example, the driver (14) can drive rotation such that the first annular member (2) rotates about the first rotation axis (5) at a rotational speed (17) of about 20 revolutions per minute.

Again referring primarily to FIG. 2 through FIG. 7, as to particular embodiments, the first coupling element (8) can be configured as a pair of opposing first coupling elements (8), for example a pair of diametrically opposed first coupling elements (8), each of which rotatably couples the first annular member (2) to the support element (9). Accordingly, the pair of opposing first coupling elements (8) can define the first rotation axis (5) about which the first annular member (2) rotates.

As to particular embodiments having the first coupling element (8) configured as a pair of opposing first coupling elements (8), the support element (9) can be configured as a pair of support elements (9), whereby each one of the pair of support elements (9) supports a corresponding one of the pair of opposing first coupling elements (8).

Again referring primarily to FIG. 2 through FIG. 7, the visual movement display system (1) further includes a second annular member (3) disposed within the first annular member (2) and a second coupling element (18) coupled to the second annular member (3), the second coupling element (18) rotatably coupling the second annular member (3) to the first annular member (2). The second coupling element (18) can define a second rotation axis (6) about which the second annular member (3) rotates.

Figure 8A:
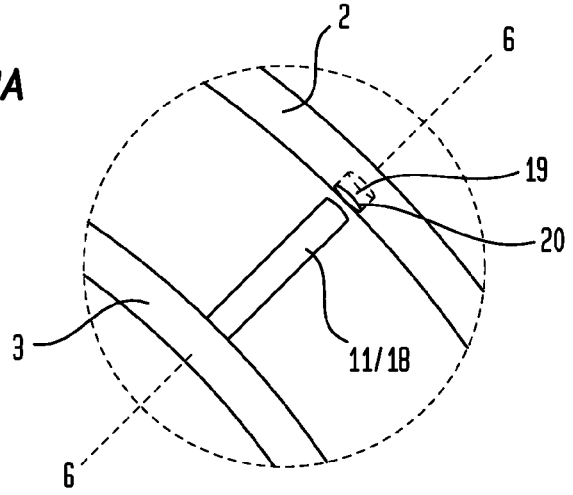
FIG. 8A is an enlarged view of a particular embodiment of a first coupling element of the visual movement display system shown in FIG. 2.

Now referring primarily to FIG. 8A, as an illustrative example, the second coupling element (18) can be configured as an elongate member (11) (such as a rod, tube, pin, or the like) having a generally circular cross-section, the elongate member (11) outwardly extending from the second annular member (3). The elongate member (11) can be rotatably received within a first annular member aperture element opening (19) bounded by a first annular member aperture element (20) disposed within the first annular member (2), the first annular member aperture element opening (19) configured to allow rotation of the elongate member (11) and correspondingly, the second annular member (3), about the second rotation axis (6) defined by the second coupling element (18) configured as the elongate member (11).

As to particular embodiments, a bearing, bushing, or the like, can be disposed within the first annular member aperture element opening (19), whereby the bearing, bushing, or the like, can rotatably receive the elongate member (11), allowing rotation of the elongate member (11) and correspondingly, the second annular member (3), about the second rotation axis (6) defined by the second coupling element (18) configured as the elongate member (11).

Figure 8B:
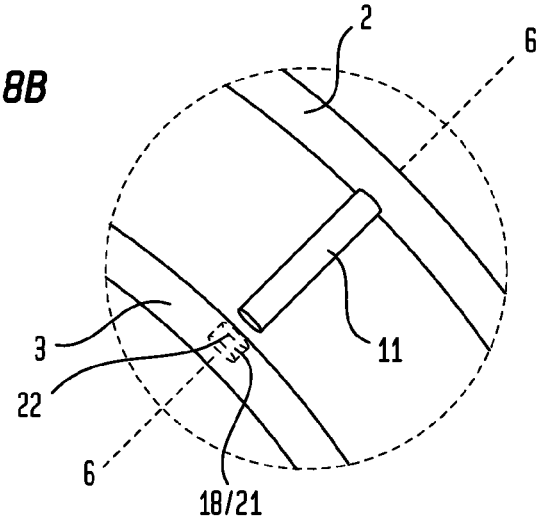
FIG. 8B is an enlarged view of a particular embodiment of a first coupling element of the visual movement display system shown in FIG. 2.

Now referring primarily to FIG. 8B, as another illustrative example, the second coupling element (18) can be configured as a second annular member aperture element opening (21) bounded by a second annular member aperture element (22) disposed within the second annular member (3). The second annular member aperture element opening (21) can rotatably receive an elongate member (11) (such as a rod, tube, pin, or the like) having a generally circular cross-section, which inwardly extends from the first annular member (2), allowing rotation of the second annular member (3) about the second rotation axis (6) defined by the second coupling element (18) configured the second annular member aperture element opening (21) bounded by the second annular member aperture element (22).

As to particular embodiments, a bearing, bushing, or the like, can be disposed within the second annular member aperture element opening (21), whereby the bearing, bushing, or the like, can rotatably receive the elongate member (11), allowing rotation of the second annular member (3) about the second rotation axis (6) defined by the second coupling element (18) configured as the second annular member aperture element opening (21) bounded by the second annular member aperture element (22).

Figure 8C:
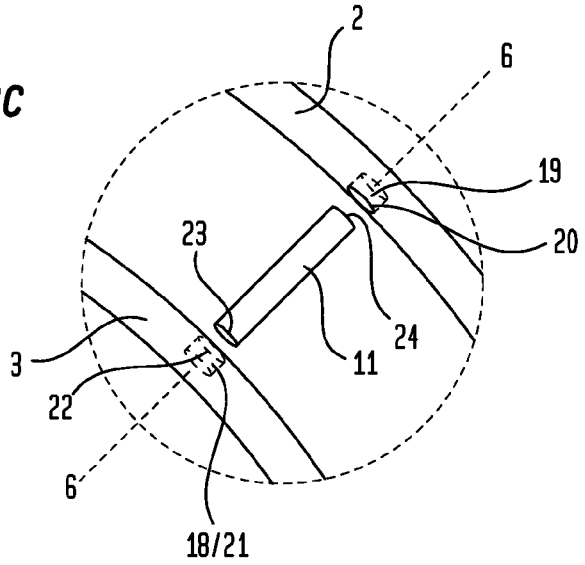
FIG. 8C is an enlarged view of a particular embodiment of a first coupling element of the visual movement display system shown in FIG. 2.

Now referring primarily to FIG. 8C, as yet another illustrative example, the second coupling element (18) can be configured as a second annular member aperture element opening (21) bounded by a second annular member aperture element (22) disposed within the second annular member (3). The second annular member aperture element opening (21) can rotatably receive a first end (23) of an elongate member (11) (such as a rod, tube, pin, or the like) having a generally circular cross-section, and a first annular member aperture element opening (19) bounded by a first annular member aperture element (20) disposed within the first annular member (2) can rotatably receive a second end (24) of the elongate member (11). Accordingly, the elongate member (11) can be disposed between the first and second annular member aperture elements (20)(22), allowing rotation of the second annular member (3) about the second rotation axis (6) defined by the second coupling element (18) configured as the second annular member aperture element opening (21) bounded by the second annular member aperture element (22).

As to particular embodiments, a bearing, bushing, or the like, can be disposed within the first and second annular member aperture element openings (19)(21), whereby the bearing, bushing, or the like, can rotatably receive the elongate member (11), allowing rotation of the second annular member (3) about the second rotation axis (6) defined by the second coupling element (18) configured as the second annular member aperture element opening (21) bounded by the second annular member aperture element (22).

Again referring primarily to FIG. 2 through FIG. 7, the second coupling element (18) can rotatably couple the second annular member (3) to the first annular member (2) such that the second rotation axis (6) can be offset in relation to the first rotation axis (5) by a first angle (25) in a range of between about of about 1 degree to about 89 degrees, whether clockwise or counterclockwise. As to particular embodiments, the first angle (25) can be selected from the group including or consisting of: between about 10 degrees to about 80 degrees; between about 20 degrees to about 70 degrees; between about 30 degrees to about 60 degrees; and between about 40 degrees to about 50 degrees. As an illustrative example, the second rotation axis (6) can be offset in relation to the first rotation axis (5) by a first angle (25) of about 45 degrees, whether clockwise or counterclockwise.

Again referring primarily to FIG. 2 through FIG. 7, as to particular embodiments, the second coupling element (18) can be configured as a pair of opposing second coupling elements (18), for example a pair of diametrically opposed second coupling elements (18), each of which rotatably couples the second annular member (3) to the first annular member (2). Accordingly, the pair of opposing second coupling elements (18) can define the second rotation axis (6) about which the second annular member (3) rotates.

Now referring primarily to FIG. 1A through FIG. 1C, rotation of the first annular member (2) about the first rotation axis (5) can generate rotation of the second annular member (3) about the second rotation axis (6), whereby the rotational speed (17) of the second annular member (3) about the second rotation axis (6) can be associated with the rotational speed (17) of the first annular member (2) about the first rotation axis (5). As a non-limiting example, a greater rotational speed (17) of the first annular member (2) about the first rotation axis (5) can generate a greater rotational speed (17) of the second annular member (3) about the second rotation axis (6) in relation to a lesser rotational speed (17) of the first annular member (2) about the first rotation axis (5), which can generate a lesser rotational speed (17) of the second annular member (3) about the second rotation axis (6).

However, as to particular embodiments, the rotational speed (17) of the second annular member (3) about the second rotation axis (6) may be dependent upon additional factors. Accordingly, as to these embodiments, the rotational speed (17) of the first annular member (2) about the first rotation axis (5) may not independently determine the rotational speed (17) of the second annular member (3) about the second rotation axis (6).

Again referring primarily to FIG. 2 through FIG. 7, the visual movement display system (1) further includes a first weight element (26) coupled to the second annular member (3). The first weight element (26) can be offset in relation to the second rotation axis (6) by a second angle (27) in a range of between about of about 1 degree to about 89 degrees, whether clockwise or counterclockwise. As to particular embodiments, the second angle (27) can be selected from the group including or consisting of: between about 10 degrees to about 80 degrees; between about 20 degrees to about 70 degrees; between about 30 degrees to about 60 degrees; and between about 40 degrees to about 50 degrees. As an illustrative example, the first weight element (26) can be offset in relation to the second rotation axis (6) by a second angle (27) of about 45 degrees, whether clockwise or counterclockwise.

The first weight element (26) can have any of a numerous and wide variety of configurations which can correspondingly have a numerous and wide variety of amounts of weight (28). As to particular embodiments, the amount of weight (28) of the first weight element (26) can be associated with the dimensional relations of the second annular member (3), the rotational speed (17) of the second annular member (3) about the second rotation axis (6), or combinations thereof.

As to particular embodiments, the first weight element (26) can be coupled to the second annular member (3) proximate a second annular member external surface (29). As to other particular embodiments, the first weight element (26) can be coupled to the second annular member (3) proximate a second annular member internal surface (30), for example within a generally hollow second annular member interior passage (31) defined by the second annular member internal surface (30).

Again referring primarily to FIG. 2 through FIG. 7, the visual movement display system (1) can further include a third annular member (4) disposed within the second annular member (3) and a third coupling element (32) coupled to the third annular member (4), the third coupling element (32) rotatably coupling the third annular member (4) to the second annular member (3). The third coupling element (32) can define a third rotation axis (7) about which the third annular member (4) rotates.

Figure 8D:
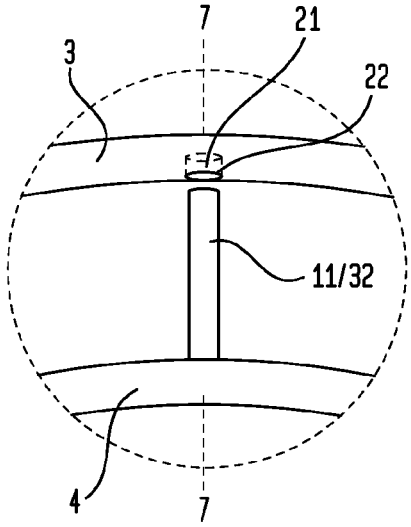
FIG. 8D is an enlarged view of a particular embodiment of a second coupling element of the visual movement display system shown in FIG. 2.

Now referring primarily to FIG. 8D, as an illustrative example, the third coupling element (32) can be configured as an elongate member (11) (such as a rod, tube, pin, or the like) having a generally circular cross-section, the elongate member (11) outwardly extending from the third annular member (4). The elongate member (11) can be rotatably received within a second annular member aperture element opening (21) bounded by a second annular member aperture element (22) disposed within the second annular member (3), the second annular member aperture element opening (21) configured to allow rotation of the elongate member (11) and correspondingly, the third annular member (4), about the third rotation axis (7) defined by the third coupling element (32) configured as the elongate member (11).

As to particular embodiments, a bearing, bushing, or the like, can be disposed within the second annular member aperture element opening (21), whereby the bearing, bushing, or the like, can rotatably receive the elongate member (11), allowing rotation of the elongate member (11) and correspondingly, the third annular member (4), about the third rotation axis (7) defined by the third coupling element (32) configured as the elongate member (11).

Figure 8E:
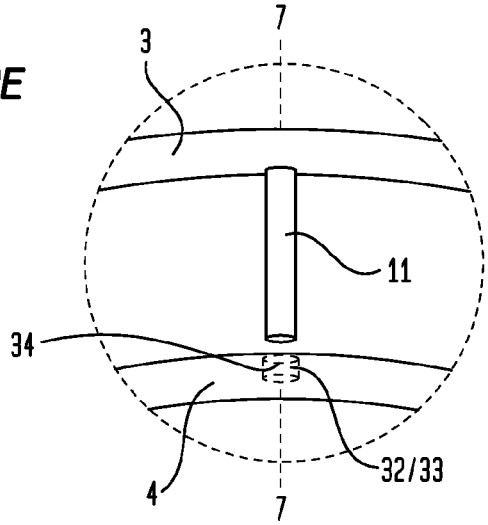
FIG. 8E is an enlarged view of a particular embodiment of a second coupling element of the visual movement display system shown in FIG. 2.
Figure 8F:
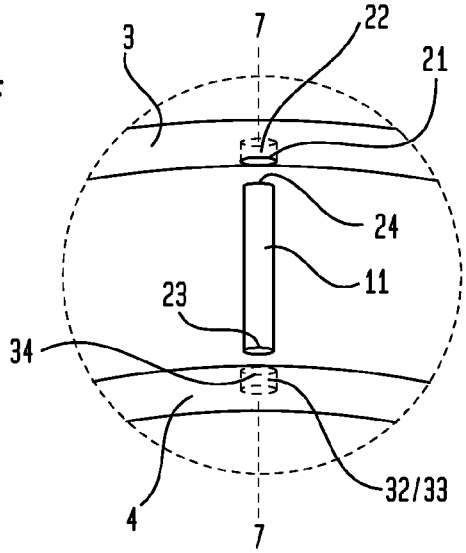
FIG. 8F is an enlarged view of a particular embodiment of a second coupling element of the visual movement display system shown in FIG. 2.

Now referring primarily to FIG. 8E, as another illustrative example, the third coupling element (32) can be configured as a third annular member aperture element opening (33) bounded by a third annular member aperture element (34) disposed within the third annular member (4). The third annular member aperture element opening (33) can rotatably receive an elongate member (11) (such as a rod, tube, pin, or the like) having a generally circular cross-section, which inwardly extends from the second annular member (3), allowing rotation of the third annular member (4) about the third rotation axis (7) defined by the third coupling element (32) configured the third annular member aperture element opening (33) bounded by the third annular member aperture element (34).

As to particular embodiments, a bearing, bushing, or the like, can be disposed within the third annular member aperture element opening (33), whereby the bearing, bushing, or the like, can rotatably receive the elongate member (11), allowing rotation of the third annular member (4) about the third rotation axis (7) defined by the third coupling element (32) configured as the third annular member aperture element opening (33) bounded by the third annular member aperture element (34).

Now referring primarily to FIG. 8C, as yet another illustrative example, the third coupling element (32) can be configured as a third annular member aperture element opening (33) bounded by a third annular member aperture element (34) disposed within the third annular member (4). The third annular member aperture element opening (33) can rotatably receive a first end (23) of an elongate member (11) (such as a rod, tube, pin, or the like) having a generally circular cross-section, and a second annular member aperture element opening (21) bounded by a second annular member aperture element (22) disposed within the second annular member (3) can rotatably receive a second end (24) of the elongate member (11). Accordingly, the elongate member (11) can be disposed between the second and third annular member aperture element openings (21)(33), allowing rotation of the third annular member (4) about the third rotation axis (7) defined by the third coupling element (32) configured the third annular member aperture element opening (33) bounded by the third annular member aperture element (34).

As to particular embodiments, a bearing, bushing, or the like, can be disposed within the second and third annular member aperture element openings (21)(33), whereby the bearing, bushing, or the like, can rotatably receive the elongate member (11), allowing rotation of the third annular member (4) about the third rotation axis (7) defined by the third coupling element (32) configured as the third annular member aperture element opening (33) bounded by the third annular member aperture element (34).

Again referring primarily to FIG. 2 through FIG. 7, the third coupling element (32) can rotatably couple the third annular member (4) to the second annular member (3) such that the third rotation axis (7) can be offset in relation to the second rotation axis (6) by a third angle (35) in a range of between about of about 1 degree to about 89 degrees, whether clockwise or counterclockwise. As to particular embodiments, the third angle (35) can be selected from the group including or consisting of: between about 10 degrees to about 80 degrees; between about 20 degrees to about 70 degrees; between about 30 degrees to about 60 degrees; and between about 40 degrees to about 50 degrees. As an illustrative example, the third rotation axis (7) can be offset in relation to the second rotation axis (6) by a third angle (35) of about 45 degrees, whether clockwise or counterclockwise.

Again referring primarily to FIG. 2 through FIG. 7, as to particular embodiments, the third coupling element (32) can be configured as a pair of opposing third coupling elements (32), for example a pair of diametrically opposed third coupling elements (32), each of which rotatably couples the third annular member (4) to the second annular member (3). Accordingly, the pair of opposing third coupling elements (32) can define the third rotation axis (7) about which the third annular member (4) rotates.

Now referring primarily to FIG. 1A through FIG. 1C, rotation of the first annular member (2) about the first rotation axis (5) and correspondingly, rotation of the second annular member (3) about the second rotation axis (6), can generate rotation of the third annular member (4) about the third rotation axis (7), whereby the rotational speed (17) of the third annular member (4) about the third rotation axis (7) can be associated with the rotational speed (17) of the first annular member (2) about the first rotation axis (5) and correspondingly, rotation of the second annular member (3) about the second rotation axis (6). As a non-limiting example, a greater rotational speed (17) of the first annular member (2) about the first rotation axis (5) and correspondingly, a greater rotational speed (17) of the second annular member (3) about the second rotation axis (6), can generate a greater rotational speed (17) of the third annular member (4) about the third rotation axis (7) in relation to a lesser rotational speed (17) of the first annular member (2) about the first rotation axis (5) and correspondingly, a lesser rotational speed (17) of the second annular member (3) about the second rotation axis (6), which can generate a lesser rotational speed (17) of the third annular member (4) about the third rotation axis (7).

However, as to particular embodiments, the rotational speed (17) of the third annular member (4) about the third rotation axis (7) may be dependent upon additional factors. Accordingly, as to these embodiments, the rotational speed (17) of the first annular member (2) about the first rotation axis (5) and correspondingly, rotation of the second annular member (3) about the second rotation axis (6), may not independently determine the rotational speed (17) of the third annular member (4) about the third rotation axis (7).

Again referring primarily to FIG. 2 through FIG. 7, the visual movement display system (1) can further include a second weight element (36) coupled to the third annular member (4). The second weight element (36) can be offset in relation to the third rotation axis (7) by a fourth angle (37) in a range of between about of about 1 degree to about 89 degrees, whether clockwise or counterclockwise. As to particular embodiments, the fourth angle (37) can be selected from the group including or consisting of: between about 10 degrees to about 80 degrees; between about 20 degrees to about 70 degrees; between about 30 degrees to about 60 degrees; and between about 40 degrees to about 50 degrees. As an illustrative example, the second weight element (36) can be offset in relation to the third rotation axis (7) by a fourth angle (37) of about 45 degrees, whether clockwise or counterclockwise.

The second weight element (36) can have any of a numerous and wide variety of configurations which can correspondingly have a numerous and wide variety of amounts of weight (28). As to particular embodiments, the amount of weight (28) of the second weight element (36) can be associated with the dimensional relations of the third annular member (4), the rotational speed (17) of the third annular member (4) about the third rotation axis (7), or combinations thereof.

As to particular embodiments, the second weight element (36) can be coupled to the third annular member (4) proximate a third annular member external surface (38). As to other particular embodiments, the second weight element (36) can be coupled to the third annular member (4) proximate a third annular member internal surface (39), for example within a generally hollow third annular member interior passage (40) defined by the third annular member internal surface (39).

Again referring primarily to FIG. 2 through FIG. 7, as to particular embodiments, the visual movement display system (1) can include first, second, and third annular members (2)(3)(4), whereby the third annular member (4) concentrically disposes within the second annular member (3) and the second annular member (3) concentrically disposes within the first annular member (2). However, the invention need not be so limited, as particular embodiments of the visual movement display system (1) can include one or more inner annular members which do not concentrically dispose within an outer annular member, another inner annular member, or combinations thereof.

Again referring primarily to FIG. 2 through FIG. 7, as to particular embodiments of the visual movement display system (1) having first, second, and third annular members (2)(3)(4), whereby the third annular member (4) concentrically disposes within the second annular member (3) and the second annular member (3) concentrically disposes within the first annular member (2), the second rotation axis (6) can be offset in relation to the first rotation axis (5) by a first angle (25) of about 45 degrees and the third rotation axis (7) can be offset in relation to the second rotation axis (6) by a third angle (35) of about 45 degrees. As an illustrative example, when the visual movement display system (1) is in a configuration whereby the first and second weight elements (26)(36) dispose in their corresponding lowermost positions relative to the support surface (10), for example when the first annular member (2) is not being driven and only gravitational forces are acting upon the visual movement display system (1), the first rotation axis (4) can be defined as 0 degrees, whereby the second rotation axis (5) can be disposed at −45 degrees (which corresponds to a 45 degree counterclockwise rotation from 0 degrees) and the third rotation axis (7) can be disposed at about −90 degrees (which corresponds to a 90 degree counterclockwise rotation from 0 degrees).

In this illustrative example, the first weight element (26) can be coupled to the second annular member (3) such that the first weight element (26) can be offset in relation to the second rotation axis (6) by a second angle (27) of about 45 degrees, thereby disposing the first weight element (26) at about +90 degrees (which corresponds to a 90 degree clockwise rotation from 0 degrees) and the second weight element (36) can be offset in relation to the third rotation axis (7) by a fourth angle (37) of about 45 degrees, thereby disposing the second weight element (36) at about +45 degrees (which corresponds to a 45 degree clockwise rotation from 0 degrees).

Again referring primarily to FIG. 2 through FIG. 7, as to particular embodiments, the visual movement display system (1) can further include an innermost element (41) disposed with the innermost annular member, for example the third annular member (4).

The innermost element (41) can be coupled to the third annular member (4) by an innermost element coupling element (42), which can be offset in relation to the third rotation axis (7) by a fifth angle (43) in a range of between about of about 1 degree to about 89 degrees, whether clockwise or counterclockwise. As to particular embodiments, the fifth angle (43) can be selected from the group including or consisting of: between about 10 degrees to about 80 degrees; between about 20 degrees to about 70 degrees; between about 30 degrees to about 60 degrees; and between about 40 degrees to about 50 degrees. As an illustrative example, the innermost element coupling element (42) can be offset in relation to the third rotation axis (7) by a fifth angle (43) of about 45 degrees, whether clockwise or counterclockwise.

As an illustrative example, when the visual movement display system (1) is in a configuration whereby the first and second weight elements (26)(36) dispose in their corresponding lowermost positions relative to the support surface (10), for example when the first annular member (2) is not being driven and only gravitational forces are acting upon the visual movement display system (1), the first rotation axis (4) can be defined as 0 degrees, whereby the second rotation axis (5) can be disposed at −45 degrees (which corresponds to a 45 degree counterclockwise rotation from 0 degrees), the third rotation axis (7) can be disposed at about −90 degrees (which corresponds to a 90 degree counterclockwise rotation from 0 degrees), the first weight element (26) can be disposed at about +90 degrees (which corresponds to a 90 degree clockwise rotation from 0 degrees), and the second weight element (36) can be disposed at about +45 degrees (which corresponds to a 45 degree clockwise rotation from 0 degrees), the innermost element coupling element (42) can be offset in relation to the third rotation axis (7) by a fifth angle (43) of about 45 degrees, thereby disposing the innermost element coupling element (42) at about +45 degrees (which corresponds to a 45 degree clockwise rotation from 0 degrees).

Again referring primarily to FIG. 2 through FIG. 7, as to particular embodiments, the innermost element (41) can be configured as a sphere (44). However, the invention need not be so limited, as the innermost element (41) can have any of a numerous and wide variety of configurations, where may or may not be symmetrical, depending upon the desired visual movement display.

Although the particular embodiment of the visual movement display system (1) shown in FIG. 1A through FIG. 7 have first, second, and third annular members (2)(3)(4), the visual movement display system (1) can include a lesser or greater number of annular members, depending upon the desired visual movement display.

Figure 9A:
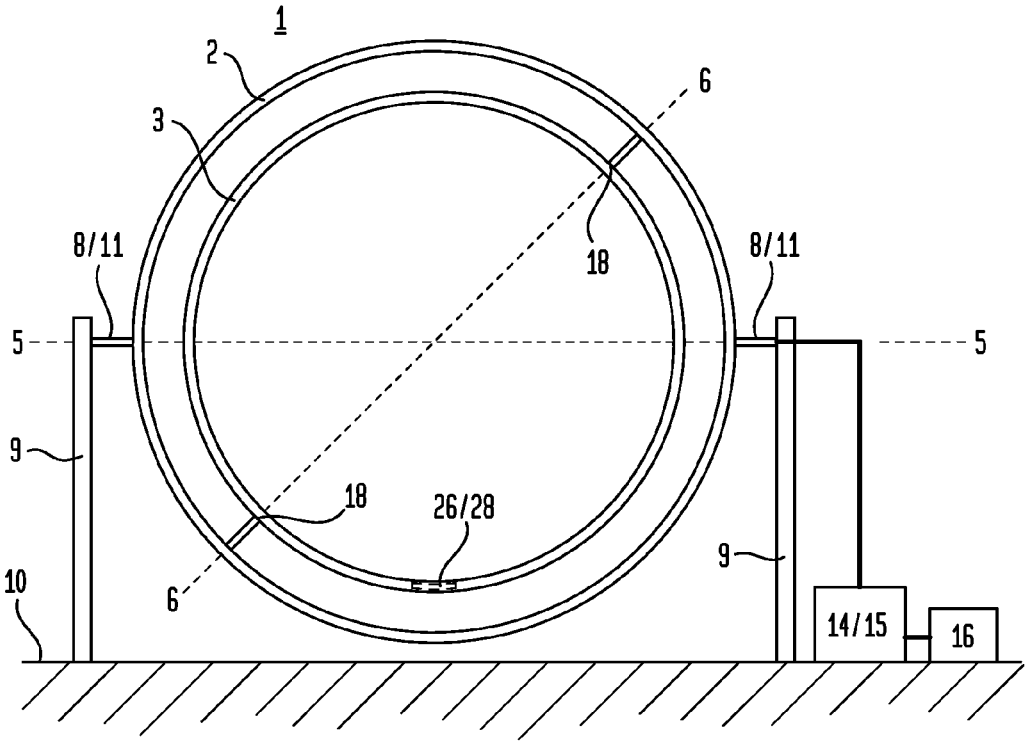
FIG. 9A is a front view of a particular embodiment of a visual movement display system.

Now referring primarily to FIG. 9A, as an illustrative example, a particular embodiment of the visual movement display system (1) can include only two annular members, whereby a second annular member (3) disposes within a first annular member (2).

Figure 9B:
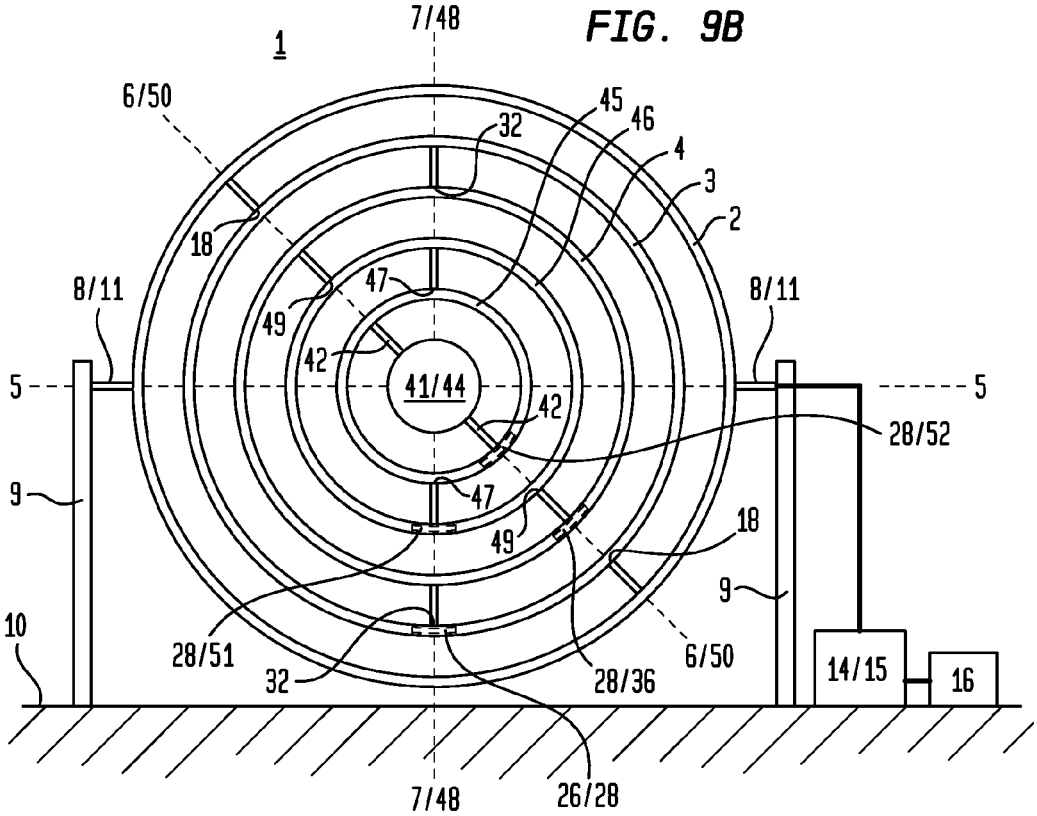
FIG. 9B is a front view of a particular embodiment of a visual movement display system.

Now referring primarily to FIG. 9B, as an additional illustrative example, another particular embodiment of the visual movement display (1) can include one or more additional annular members, such as five annular members, whereby each annular member, except for the outermost annular member, disposes within an adjacent annular member. For example, a fifth annular member (45) can be disposed within a fourth annular member (46), the fifth annular member (45) rotatably coupled to the fourth annular member (46) by a fifth coupling element (47) defining a fifth rotation axis (48) about which the fifth annular member (45) rotates. The fourth annular member (46) can be disposed within a third annular member (4), the fourth annular member (46) rotatably coupled to the third annular member (4) by a fourth coupling element (49) defining a fourth rotation axis (50) about which the fourth annular member (46) rotates. The third annular member (4) can be disposed within a second annular member (3), the third annular member (4) rotatably coupled to the second annular member (3) by a third coupling element (32) defining a third rotation axis (7) about which the third annular member (4) rotates. The second annular member (3) can be disposed within a first annular member (2), the second annular member (3) rotatably coupled to the first annular member (2) by a second coupling element (18) defining a second rotation axis (6) about which the second annular member (3) rotates. The first annular member (2) can be rotatably coupled to a support element (9) by a first coupling element (8) defining a first rotation axis (5) about which the first annular member (2) rotates.

As to particular embodiments, the dimensional relations of the annular members and the amounts of weight (28) of the weight elements can be configured to generate a desired visual movement display, which when viewed by a viewer, can be entertaining, amusing, enjoyable, or the like, or combinations thereof. As a non-limiting example, a particular embodiment of the visual movement display system (1) can include five generally circular annular members whereby a fifth annular member (45) having a diameter of about 12 inches (about 0.31 meters) disposes within a fourth annular member (46) having a diameter of about 18 inches (about 0.46 meters), which disposes within a third annular member (4) having a diameter of about 24 inches (0.61 meters), which disposes within a second annular member (3) having a diameter of about 30 inches (about 0.76 meters), which disposes within a first annular member (2) having a diameter of about 36 inches (about 0.91 meters), as shown in the example of FIG. 9B. Correspondingly, a first weight element (26) coupled to the second annular member (3) can have an amount of weight (28) of about 1.4 pounds (about 0.64 kilograms), a second weight element (36) coupled to the third annular member (4) can have an amount of weight (28) of about 1 pound (about 0.45 kilograms), a third weight element (51) coupled to the fourth annular member (46) can have an amount of weight (28) of about 0.6 pounds (about 0.27 kilograms), and a fourth weight element (52) coupled to the fifth annular member (45) can have an amount of weight (28) of about 0.3 pounds (about 0.14 kilograms). Together, the dimensional relations of the annular members and the amounts of weight (28) of the weight elements can generate a desired visual movement display upon rotation of the first annular member (2), which when viewed by a viewer, can be entertaining, amusing, enjoyable, or the like, or combinations thereof.

As to other particular embodiments, the dimensional relations of the annular members and the amounts of weight (28) of the weight elements can be scaled in relation to the above-described non-limiting example, whereby a lesser scaling can provide a relatively smaller visual movement display system (1) in relation to a greater scaling, which can provide a relatively larger visual movement display system (1).

A method of making a visual movement display system (1) can include providing a first annular member (2); rotatably coupling the first annular member (2) to a support element (9) with a first coupling element (8), the first coupling element (8) defining a first rotation axis (5) about which the first annular member (2) rotates; disposing a second annular member (3) within the first annular member (2); rotatably coupling the second annular member (3) to the first annular member (2) with a second coupling element (18), the second coupling element (18) defining a second rotation axis (6) about which the second annular member (3) rotates; whereby the second rotation axis (6) can be offset in relation to the first rotation axis (5) by a first angle (25) in a range of between about of about 1 degree to about 89 degrees; and coupling a first weight element (26) to the second annular member (3), whereby the first weight element (26) can be offset in relation to the second rotation axis (6) by a second angle (27) in a range of between about of about 1 degree to about 89 degrees.

As to particular embodiments, the support element (9) can support the first annular member (2) above a support surface (10); whereby the first coupling element (8) rotatably couples the first annular member (2) to the support element (9) to dispose the first rotation axis (5) in generally parallel relation to the support surface (10).

As to other particular embodiments, the support element (9) can support the first annular member (2) above a support surface (10); whereby the first coupling element (8) rotatably couples the first annular member (2) to the support element (9) to dispose the first rotation axis (5) in angled relation to the support surface (10).

As to particular embodiments, the method can further include operably coupling a driver (14) to the first annular member (2) to drive rotation of the first annular member (2) about the first rotation axis (5). As to particular embodiments, the method can further include connecting the driver (14) to the first coupling element (8).

As to particular embodiments, the method can further include operably coupling a power source (16) to the driver (14) to provide power to the driver (14).

As to particular embodiments, the driver (14) can generate a rotational speed (17) of the first annular member (2) about the first rotation axis (5), whereby the rotational speed (17) can be in a range of between about X revolutions per minute to about Y revolutions per minute. As to particular embodiments, the rotational speed (17) can be selected from the group including or consisting of:

As to particular embodiments, the method can further include configuring the first coupling element (8) as a pair of opposing first coupling elements (8), each of which rotatably couples the first annular member (2) to the support element (9). As to particular embodiments, the method can further include configuring the support element (9) as a pair of support elements (9), whereby each one of the pair of support elements (9) supports a corresponding one of the pair of opposing first annular member coupling elements (8).

As to particular embodiments, the method can further include configuring the second coupling element (18) as a pair of opposing second coupling elements (18), each of which rotatably couples the second annular member (3) to the first annular member (2).

As to particular embodiments, the method can further include disposing the first weight element (26) within a generally hollow second annular member interior passage (31) defined by a second annular member internal surface (30) of the second annular member (3).

As to particular embodiments, the method can further include disposing a third annular member (4) within the second annular member (3); rotatably coupling the third annular member (4) to the second annular member (3) with a third coupling element (32), the third coupling element (32) defining a third rotation axis (7) about which the third annular member (4) rotates; whereby the third rotation axis (7) can be offset in relation to the second rotation axis (6) by a third angle (35) in a range of between about of about 1 degree to about 89 degrees; and coupling a second weight element (36) to the third annular member (4), whereby the second weight element (36) can be offset in relation to the third rotation axis (7) by a fourth angle (37) in a range of between about of about 1 degree to about 89 degrees.

As to particular embodiments, the method can further include configuring the third coupling element (32) as a pair of opposing third coupling elements (32), each of which rotatably couples the third annular member (4) to the second annular member (3).

As to particular embodiments, the method can further include disposing the second weight element (6) within a generally hollow third annular member interior passage (40) defined by a third annular member internal surface (39) of the third annular member (4).

As to particular embodiments, the method can further include disposing an innermost element (41) within the third annular member (4) and coupling the innermost element (41) to the third annular member (4) with an innermost element coupling element (42), whereby the innermost element coupling element (42) can be offset in relation to the third rotation axis (7) by a fifth angle (43) in a range of between about of about 1 degree to about 89 degrees.

As to particular embodiments, the method can further include disposing at least one additional annular member within the third annular member (4).

A method of using a visual movement display system (1) can include providing the visual movement display system (1) including a first annular member (2); a first coupling element (8) coupled to the first annular member (2), the first coupling element (8) rotatably coupling the first annular member (2) to a support element (9), the first coupling element (8) defining a first rotation axis (5) about which the first annular member (2) rotates; a second annular member (3) disposed within the first annular member (2); a second coupling element (18) coupled to the second annular member (3), the second coupling element (18) rotatably coupling the second annular member (3) to the first annular member (2), the second coupling element (18) defining a second rotation axis (6) about which the second annular member (3) rotates; whereby the second rotation axis (6) can be offset in relation to the first rotation axis (5) by a first angle (25) in a range of between about of about 1 degree to about 89 degrees; and a first weight element (26) coupled to the second annular member (3), whereby the first weight element (26) can be offset in relation to the second rotation axis (6) by a second angle (27) in a range of between about of about 1 degree to about 89 degrees; and rotating the first annular member (2) about the first rotation axis (5).

As to particular embodiments, rotating the first annular member (2) about the first rotation axis (5) can further include driving the first annular member (2) about the first rotation axis (5) with a driver (14).

As to particular embodiments, driving the first annular member (2) about the first rotation axis (5) with the driver (14) further includes providing power to the driver (14) with a power source (16).

As to particular embodiments, the driver (14) can generate a rotational speed (17) of the first annular member (2) about the first rotation axis (5), whereby the rotational speed (17) of the first annular member (2) about the first rotation axis (5) generates at least one rotational speed (17) of at least one additional annular member to provide a visual movement display which can be viewed by a viewer for entertainment, amusement, enjoyment, or the like, or combinations thereof.

As can be easily understood from the foregoing, the basic concepts of the present invention may be embodied in a variety of ways. The invention involves numerous and varied embodiments of a visual movement display system and methods for making and using such visual movement display systems, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "support" should be understood to encompass disclosure of the act of "supporting"—whether explicitly discussed or not—and, conversely, were there effectively disclosure of the act of "supporting", such a disclosure should be understood to encompass disclosure of a "support" and even a "means for supporting". Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

All degree values herein are assumed to be both positive (clockwise from an axis) and negative (counterclockwise from an axis) unless denoted as positive with a "+", whereby the degree value is only positive (clockwise from an axis) or denoted as negative with a "−", whereby the degree value is only negative (counterclockwise from an axis).

Moreover, for the purposes of the present invention, the term "a" or "an" entity refers to one or more of that entity unless otherwise limited. As such, the terms "a" "an", "one or more" and "at least one" can be used interchangeably herein.

Thus, the applicant(s) should be understood to claim at least: i) each of the visual movement display systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A visual movement display system comprising:

i) a first annular member rotatably coupled to a support element at a first connection point which defines a first rotation axis about which said first annular member rotates;

ii) a second annular member disposed within said first annular member, said second annular member rotatably coupled to said first annular member at a second connection point which defines a second rotation axis about which said second annular member rotates;

iii) a third annular member disposed within said second annular member, said third annular member rotatably coupled to said second annular member at a third connection point which defines a third rotation axis about which said third annular member rotates;

wherein each of said first, second, and third annular members is formed from a tube;

wherein each of said first, second, and third axes is offset from an adjacent axis by an angle in a range of between about 30 degrees to about 60 degrees;

iv) an innermost element disposed within said third annular member, said innermost element coupled to said third annular member at a fourth connection point;

v) a first weight element disposed within said tube forming said second annular member at said third connection point;

vi) a second weight element disposed within said tube forming said third annular member at said fourth connection point;

wherein said first and second weight elements are graduated such that an outer-more weight element has a greater amount of weight than an inner-more weight element; and vii) a driver operably coupled to said first annular member to drive rotation of said first annular member about said first rotation axis;

wherein, as a result of said angles and graduation of said first and second weight elements, rotation of said first annular member about said first rotation axis generates rotation of said second and third annular members.

2. The visual movement display system of claim 1, further comprising a power source operably coupled to said driver to provide power to said driver.

3. The visual movement display system of claim 1, wherein said angles are about 45 degrees.

4. The visual movement display system of claim 1, further comprising at least one additional annular member disposed within said third annular member.

5. The visual movement display system of claim 1, wherein said driver generates a rotational speed of said first annular member about said first rotation axis, said rotational speed in a range of between about 5 revolutions per minute to about 60 revolutions per minute.

6. A visual movement display system comprising:

i) a first annular member rotatably coupled to a support element at a first connection point which defines a first rotation axis about which said first annular member rotates;

ii) a second annular member disposed within said first annular member, said second annular member rotatably coupled to said first annular member at a second connection point which defines a second rotation axis about which said second annular member rotates;

iii) a third annular member disposed within said second annular member, said third annular member rotatably coupled to said second annular member at a third connection point which defines a third rotation axis about which said third annular member rotates;

iv) a fourth annular member disposed within said third annular member, said fourth annular member rotatably coupled to said third annular member at a fourth connection point which defines a fourth rotation axis about which said fourth annular member rotates;

wherein each of said first, second, third, and fourth annular members is formed from a tube;

wherein each of said first, second, third, and fourth axes is offset from an adjacent axis by an angle in a range of between about 30 degrees to about 60 degrees;

v) a first weight element disposed within said tube forming said second annular member at said third connection point;

vi) a second weight element disposed within said tube forming said third annular member at said fourth connection point;

wherein said first and second weight elements are graduated such that an outer-more weight element has a greater amount of weight than an inner-more weight element; and vii) a driver operably coupled to said first annular member to drive rotation of said first annular member about said first rotation axis;

wherein, as a result of said angles and graduation of said first and second weight elements, rotation of said first annular member about said first rotation axis generates rotation of said second and third annular members.

7. The visual movement display system of claim 6, further comprising a power source operably coupled to said driver to provide power to said driver.

8. The visual movement display system of claim 6, wherein said angles are about 45 degrees.

9. The visual movement display system of claim 6, further comprising at least one additional annular member disposed within said fourth annular member.

10. The visual movement display system of claim 6, wherein said driver generates a rotational speed of said first annular member about said first rotation axis, said rotational speed in a range of between about 5 revolutions per minute to about 60 revolutions per minute.

11. A method of making a visual movement display system, comprising:

i) rotatably coupling a first annular member to a support element at a first connection point which defines a first rotation axis about which said first annular member rotates;

ii) disposing a second annular member within said first annular member by rotatably coupling said second annular member to said first annular member at a second connection point which defines a second rotation axis about which said second annular member rotates;

iii) disposing a third annular member within said second annular member by rotatably coupling said third annular member to said second annular member at a third connection point which defines a third rotation axis about which said third annular member rotates;

wherein each of said first, second, and third annular members is formed from a tube;

wherein each of said first, second, and third axes is offset from an adjacent axis by an angle in a range of between about 30 degrees to about 60 degrees;

iv) disposing an innermost element within said third annular member by coupling said innermost element to said third annular member at a fourth connection point;

v) disposing a first weight element within said tube forming said second annular member at said third connection point;

vi) disposing a second weight element within said tube forming said third annular member at said fourth connection point;

wherein said first and second weight elements are graduated such that an outer-more weight element has a greater amount of weight than an inner-more weight element; and vii) operably coupling a driver to said first annular member to drive rotation of said first annular member about said first rotation axis;

wherein, as a result of said angles and graduation of said first and second weight elements, rotation of said first annular member about said first rotation axis generates rotation of said second and third annular members.

12. The method of claim 11, further comprising operably coupling a power source to said driver to provide power to said driver.

13. The method of claim 11, further comprising configuring said angles as about 45 degrees.

14. The method of claim 11, further comprising disposing at least one additional annular member within said third annular member.

15. The method of claim 11, further comprising configuring said driver to generate a rotational speed of said first annular member about said first rotation axis, said rotational speed in a range of between about 5 revolutions per minute to about 60 revolutions per minute.

16. A method of making a visual movement display system comprising:

i) rotatably coupling a first annular member to a support element at a first connection point which defines a first rotation axis about which said first annular member rotates;

ii) disposing a second annular member within said first annular member by rotatably coupling said second annular member to said first annular member at a second connection point which defines a second rotation axis about which said second annular member rotates;

iii) disposing a third annular member within said second annular member by rotatably coupling said third annular member to said second annular member at a third connection point which defines a third rotation axis about which said third annular member rotates;

iv) disposing a fourth annular member within said third annular member by rotatably coupling said fourth annular member to said third annular member at a fourth connection point which defines a fourth rotation axis about which said fourth annular member rotates;

wherein each of said first, second, third, and fourth annular members is formed from a tube;

wherein each of said first, second, third, and fourth axes is offset from an adjacent axis by an angle in a range of between about 30 degrees to about 60 degrees;

v) disposing a first weight element within said tube forming said second annular member at said third connection point;

vi) disposing a second weight element within said tube forming said third annular member at said fourth connection point;

wherein said first and second weight elements are graduated such that an outer-more weight element has a greater amount of weight than an inner-more weight element; and vii) operably coupling a driver to said first annular member to drive rotation of said first annular member about said first rotation axis;

wherein, as a result of said angles and graduation of said first and second weight elements, rotation of said first annular member about said first rotation axis generates rotation of said second and third annular members.

17. The method of claim 16, further comprising operably coupling a power source to said driver to provide power to said driver.

18. The method of claim 16, further comprising configuring said angles as about 45 degrees.

19. The method of claim 16, further comprising disposing at least one additional annular member within said third annular member.

20. The method of claim 16, further comprising configuring said driver to generate a rotational speed of said first annular member about said first rotation axis, said rotational speed in a range of between about 5 revolutions per minute to about 60 revolutions per minute.

* * * * *